United States Patent [19]

Buchs et al.

[11] 4,300,354

[45] Nov. 17, 1981

[54] SUSPENSION SYSTEM FOR A LOW TEMPERATURE TANK

[75] Inventors: Wolfgang Buchs, Valley; Martin Müeller, Siegertsbrunn; Werner Malburg, Neubiberg; Albert Seidel, Siegertsbrunn, all of Fed. Rep. of Germany

[73] Assignee: Messerschmitt-Boelkow-Blohm Gesellschaft mit beschraenkter Haftung, Munich, Fed. Rep. of Germany

[21] Appl. No.: 116,888

[22] Filed: Jan. 30, 1980

[30] Foreign Application Priority Data

Feb. 1, 1979 [DE] Fed. Rep. of Germany ..... 2903787

[51] Int. Cl.[3] ..... F17C 7/02

[52] U.S. Cl. ..... 62/45; 220/435; 220/445

[58] Field of Search ..... 62/45, 514 R; 220/435, 220/437, 445, 446, 448

[56] References Cited

U.S. PATENT DOCUMENTS

| | | | |
|---|---|---|---|
| 3,069,042 | 12/1962 | Johnston | 62/45 |
| 3,078,755 | 2/1963 | Chase, Jr. | 87/6 |
| 3,155,265 | 3/1964 | Reese | 220/437 |
| 3,817,047 | 6/1974 | Hampton | 62/45 |
| 3,913,775 | 10/1975 | Ozaki | 220/437 |

*Primary Examiner*—Ronald C. Capossela

*Attorney, Agent, or Firm*—W. G. Fasse; D. F. Gould

[57] ABSTRACT

A low temperature tank is suspended in an outer shell or container by a plurality of straps of fiber compound materials. Each strap comprises a plurality of individual strap elements arranged in series. The strap elements are made of different fibers whereby the strap element closest to the tank is made of a fiber material having the lowest heat expansion coefficient as compared to the heat expansion coefficient of the other elements of a strap further away from the tank. Preferably the strap elements are thermally insulated from each other. In that case the strap elements need not necessarily be made of fiber materials having different heat expansion coefficients.

14 Claims, 5 Drawing Figures

SUSPENSION SYSTEM FOR A LOW TEMPERATURE TANK

BACKGROUND OF THE INVENTION

The invention relates to a suspension system for suspending a low temperature tank in an outer shell, whereby the connection between the outer shell and the low temperature tank is accomplished by a plurality of straps made of fiber compound materials.

It is well known to use fiber compound materials for suspension systems of the above type because of the desirable material characteristics of such materials. The connecting or securing straps are formed as integral single piece members and preferably the fiber orientation is uni-directional relative to the longitudinal extension of the strap or straps. Among the material characteristics desirable for the intended purpose, are the following: the high material strength, the stiffness, the low weight as well as the small creep rates under load. In addition to the large mechanical loads the connecting straps must also satisfy enormous thermal load requirements. On the one hand it is required that the straps have a high resistance to heat conduction so that there will not be formed a thermal bridge between the outer shell and the low temperature tank when the latter is in its cold condition. On the other hand the straps must remain under substantially uniform tension loads under all operating conditions to assure a precise fixing of the low temperature tank inside the outer shell. This operating condition must be assured in spite of large temperature variations of the inner, low temperature tank. This temperature variation may range from room temperature when the tank is empty to extremely low temperatures when the tank is filled, for example, with a liquified gas. It has been found that prior art suspension straps made as single piece, integral components, are not capable to satisfactorily handle these thermal loads although the mechanical strength and stiffness of prior art suspension systems are satisfactory.

Where prior art suspension straps are made of glass fibers it is possible to make sure that the connecting straps have a sufficiently high resistance against thermal conduction. However, the changes in strap length due to thermal expansion in response to the temperature changes between the lowest temperature condition and room temperature when the tank is empty, are so large that unpermissible conditions occur. Thus, in the cold condition the straps may be exposed to unpermissible excess tensions. On the other hand, when the tank warms up to room temperature a precise suspension or fixing of the tank is not assured any more due to the excessive increase in strap length. When the integral, single piece connecting straps are made of carbon fibers, it is possible to keep the tension load variations sufficiently small throughout the entire temperature range between the room temperature and the lowest possible temperature of the inner, low temperature tank. However, due to the relatively large heat conduction coefficient of carbon fiber material on excessive heat flow along the connecting straps cannot be avoided when the inner tank is in its low temperature, filled condition.

Even where different fiber types are used for the connecting straps, it has been impossible heretofore to avoid, depending on the type of fibers, either an excessively high tension load variation between the room temperature and the low temperature level of the inner tank or to avoid an excessively large heat flow along the connecting straps in the cold condition of the inner tank.

OBJECTS OF THE INVENTION

In view of the above it is the aim of the invention to achieve the following objects singly or in combination:

to provide a highly safe suspension for a low temperature tank in an outer shell with regard to the mechanical loads as well as with regard to the thermal loads;

to make sure that the suspension straps will remain subject to substantially uniform loads throughout the possible temperature range to which they may be exposed in operation;

to assure a precisely defined position of the suspended tank under all mechanical and temperature load conditions;

to construct the suspension straps in such a manner that they provide a large resistance against heat conduction under all operating conditions; and to construct the suspension straps from individual elements, the length of which may vary depending on the heat conducting and heat expansion characteristic of the individual strap element.

SUMMARY OF THE INVENTION

According to the invention there is provided a suspension system for securing the position of a low temperature tank in an outer shell or container. Such a system is characterized in that each of a plurality of connecting straps comprises a plurality of individual strap elements operatively interconnected in series with one another and made of different fiber materials, and in that the individual strap element of each connecting strap closest to the suspended tank is made of a fiber material having the lowest heat expansion coefficient relative to the heat expansion coefficient of the other strap elements of a strap.

In an alternative embodiment according to the invention each suspension strap also comprises a plurality of individual strap elements and additionally these strap elements are thermally insulated from one another by means of insulation pieces inserted between adjacent strap elements. The second embodiment of the invention may be used individually or in combination with the features of the first embodiment. In both instances the subdivision of the connecting straps into several serially interconnected individual strap elements made of different or the same fiber materials, the thermal material characteristics in the longitudinal direction of each strap are used in steps so to speak, whereby the individual strap element having the lowest thermal expansion coefficient is arranged closest to the tank being suspended. Thus, the thermal expansion coefficient of the individual strap elements decreases in steps along the length of each strap from its outer end inwardly toward the suspended tank. The smallest temperature expansion coefficient material is employed where it is most effective, namely, adjacent to the inner tank where the largest temperature difference between the filled, cold condition of the tank and its unfilled condition occurs. The strap elements located closer to the outer shell or container are subjected to decreasing temperature variations which are controlling for the heat expansion or contraction. thus, these strap elements closer to the outer shell are made of a fiber material having a relatively higher heat expansion coefficient, but simultaneously also a lower heat conduction coefficient. As a result, it is possible to substantially improve the heat conduction characteristic as well as the heat expansion characteristic of the suspension system according to the invention as compared to a conventional suspension system employing single piece connecting or suspension straps.

The use of intermediate members made of insulating material between serially arranged individual strap elements according to the second embodiment of the invention also permits a substantial improvement in the heat expansion characteristic as well as in the heat conduction characteristic of the straps. The intermediate members of insulating material cause a substantial localized throttling of the heat flow. Simultaneously it is possible to achieve a substantially uniform tensioning of the individual strap elements by a respective selection of the fiber material of which these individual strap elements are made in order to take into account the occurring temperature variations between the room temperature and the lowest temperature level of the inner tank. Thus, the resistance to the heat conduction can be substantially increased relative to the tension load variations to which the connecting straps are subjected due to the minimum and maximum operating temperature of the inner tank causing heat expansions while simultaneously maintaining a high strength as well as stiffness of the connecting straps.

BRIEF FIGURE DESCRIPTION

In order that the invention may be clearly understood, it will now be described, by way of example, with reference to the accompanying drawings, wherein:

FIG. 1*a* shows in a somewhat schematic, perspective illustration the geometric arrangement of the securing straps of a suspension system arranged between an outer shell or container and a low temperature tank suspended inside the outer shell or container;

FIG. 1*b* illustrates a top plan view of the arrangement according to FIG. 1*a;*

DETAILED DESCRIPTION OF PREFERRED EXAMPLE EMBODIMENTS AND OF THE BEST MODE OF THE INVENTION

Figure 1A:
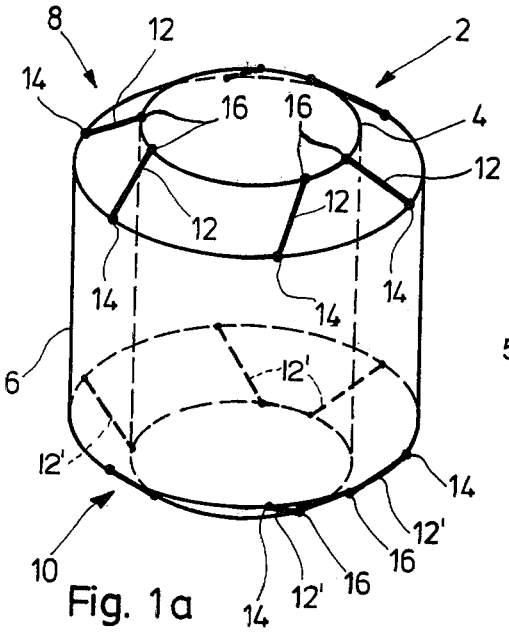
Figure 1B:
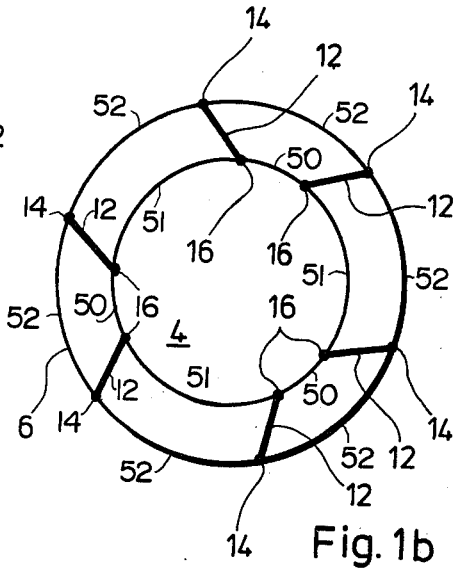
Figure 2:
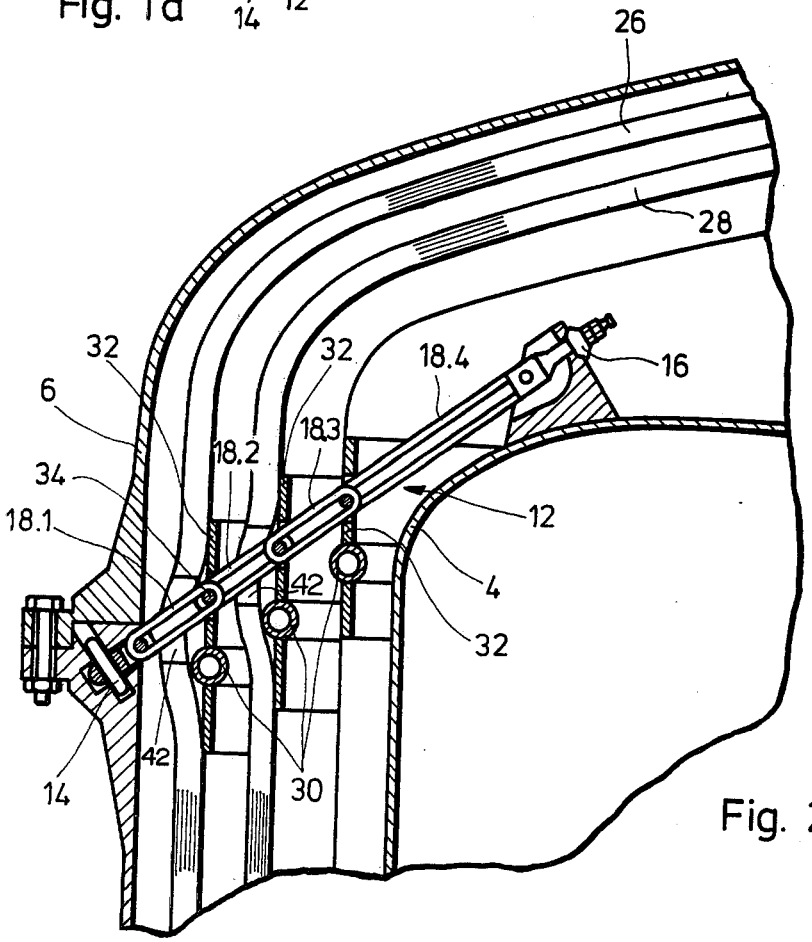
FIG. 2 illustrates, partially in section, the arrangement of a connecting strap according to the invention.

Referring to FIGS. 1*a* and 1*b*, the suspension system 2 according to the invention comprises a first group 8 of upper securing straps 12 and a second group 10 of lower securing straps 12'. Each group comprises, for example, six securing straps 12, 12' for coaxially suspending the low temperature tank 4 in the outer container or shell 6. Each securing strap is connected under tension between an outer anchoring point 14 secured to the outer shell and an inner anchoring point 16 secured to the low temperature tank 4. The outer anchoring point 14 may comprise a bolt as best seen in FIG. 2. The inner anchoring point 16 may comprise a tensioning screw or nut also as best seen in FIG. 2.

The securing straps 12, 12' are inclined relative to the longitudinal central axis of the tank 4 in such a manner that the axial spacing between the upper group 8 and the lower group 10 of straps increases from the outer shell 6 radially inwardly to the tank 4. Further, and referring specifically to FIG. 1*b* the straps 12, 12' are arranged in pairs so that the inner anchoring points 16 of a pair of straps are closer together on the tank 4 than the anchoring points 16 of adjacent pairs of straps. Thus, the spacings 50 between the anchoring points 16 of a pair of straps are shorter than the spacings 51 on the tank 4. The anchoring points 14 on the outer shell 6 are distributed substantially uniformly so that the spacings 52 are also of substantially uniform length.

If the low temperature tank 4 is being filled, for example with a liquid gas, it cools down whereby the axial length of the tank 4 is reduced due to thermal contraction. Therefore, the axial spacing between axially aligned anchoring points 16 is correspondingly reduced. However, there is also a radially effective thermal contraction of the tank 4 so that the change in length of the securing straps 12, 12' due to temperature changes is partially compensated. This compensation is enhanced by the above described spacings between the anchoring points as shown in FIG. 1*b*. Due to the different spacings 50 and 51 and due to the substantially uniform spacings 52 the straps extend in pairs in a convergent manner relative to the inner tank 4. Due to this feature the angle of inclination of the individual securing straps 12, 12' relative to a radial plane extending through the anchoring points 14, is reduced, whereby also a partial compensation of thermally caused length changes is achieved. Yet another advantage of the described arrangement of the securing straps so that pairs of straps converge substantially radially inwardly, is seen in that a stable fixation of the inner tank 4 inside the outer shell 6 is achieved in the axial direction as well as in the radial direction and also in the rotational direction.

In addition to the above described mechanical or geometric arrangement of the securing straps relative to each other, their individual construction is also important having regard to the high thermal and mechanical loads to which the suspension system 2 is subjected in operation. According to the invention each individual securing strap 12, 12' comprises a plurality of individual strap elements, for example, 18.1, 18.2, 18.3, and 18.4. Securing means 34, to be described in more detail below, connect the individual strap elements in series as best seen in FIG. 2. The strap elements are made of fiber compound materials, whereby each element 18.1, 18.2, 18.3, and 18.4 may be made of a different fiber compound material formed into one or several, parallel, and endlessly wound double loops 20 such, that the fibers extend uniformly in the same direction as best seen in FIG. 4, said uniform direction being indicated by the double arrows 53.

Figure 3:
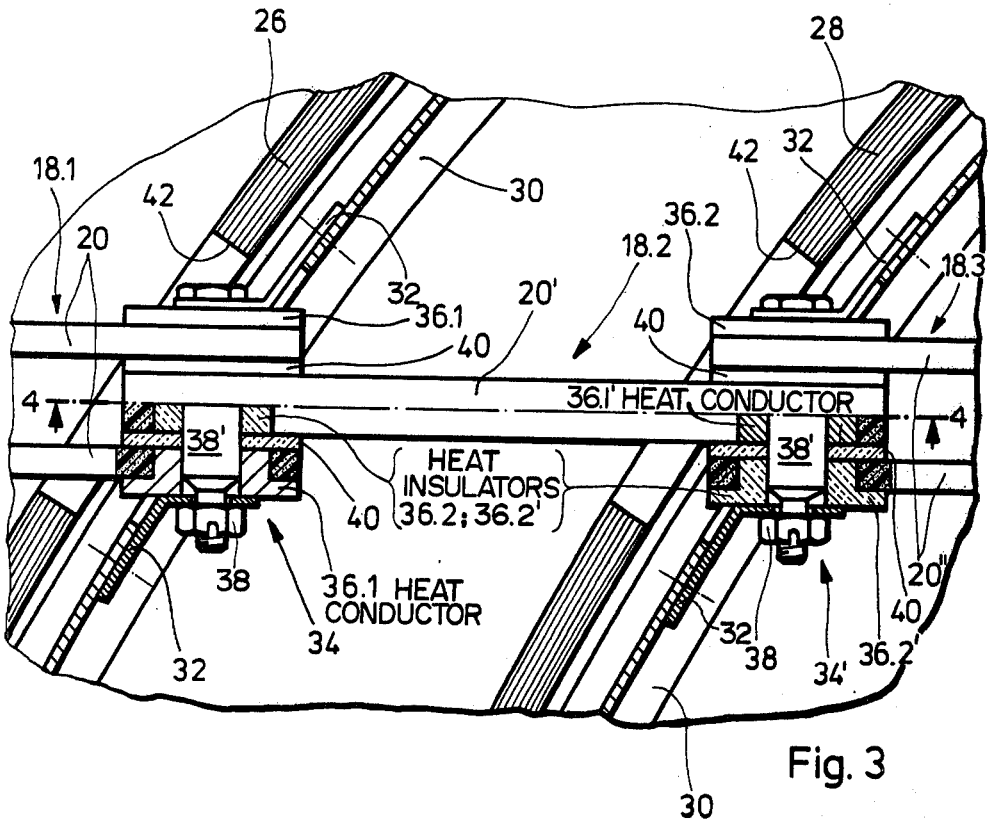
FIG. 3 is also a partially sectional view of a suspension strap according to FIG. 2 on an enlarged scale and simultaneously showing intermediate members of insulating material between adjacent strap elements.
Figure 4:
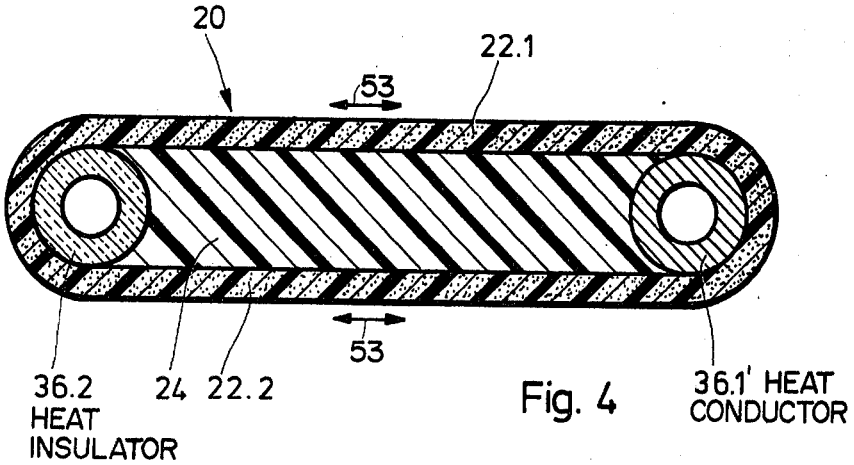
FIG. 4 is a sectional view through an individual strap element along section line 4—4 in FIG. 3.

Referring specifically to FIG. 4, the endless loop 20 comprises in the space between its longitudinal legs 22.1 and 22.2 a filler member 24 operating as a radiation shield. The radiation shield may, for example, be made of polyphthalate film coated with aluminum. The individual strap elements 18.1, 18.2, and so forth are made, according to the invention, of different types of fibers and are arranged in such a manner that the heat expansion coefficient decreases from the outer shell 6 to the inner tank 4. Accordingly the heat conduction coefficient increases in the same direction and due to the material characteristics. For example, the individual strap element 18.1 located closest to the outer shell 6 may be made of glass fibers having a heat conduction coefficient $\lambda$ of about $2.5\times10^{-3}$ W/cmK (Watts per centimeter degree Kelvin) and a thermal expansion coefficient $\alpha$ of about $7\times10^{-6}$ 1/K (per degree Kelvin). The centrally located subelements 18.2 and 18.3 may be made of polyaramide fibers having a value of $\lambda$ of about $1\times10^{-2}$ and a value of $\alpha$ of about $-5\times10^{-6}$. The innermost strap elements 18.4, which also may be longer than the other elements as shown in FIG. 2, may be made of carbon fibers having a value of $\lambda$ of about $6\times10^{-2}$ and a value of $\alpha$ of about $-0.2$ Referring again to FIGS. 2 and 3 the space between the shell 6 and the inner container 4 is conventionally evacuated to improve the heat insulation. The tank may, for example, be filled with liquid helium. One or several radiation shields may be operatively located in the space between the shell 6 and the tank 4 to encase the tank 4. The radiation shield 26, 28 may also be made of aluminum coated polyphthalate film. Cooling ducts 30, shown in FIG. 2, are operatively connected to the shields 26, 28 and so forth. These cooling ducts 30 may be so arranged that any helium vapor that may, for example, occur during an experiment, is conducted outwardly through these cooling ducts 30. The radiation shields 26, 28 are operatively secured to the suspension straps adjacent to the cooling ducts 30 by means of intermediate sheet metal brackets 32 and by the securing means 34 two of which are shown in greater detail in FIG. 3.

Referring to FIG. 3, all the securing means 34 are substantially of the same construction and comprise a nut 38 cooperating with a bolt 38' both of which are made of heat conducting material. Additionally each securing means 34 comprises a plurality of intermediate members. Certain of these members are made of heat insulating material and certain other of these members are made of heat conducting material. These intermediate members are arranged in such a manner that a heat flow is assured from the right-hand end of at least some of the straps into the radiation shields through the heat conducting brackets 32 and that a heat flow from the right-hand end of any strap element to the next adjacent strap element is substantially impeded. Thus, heat flowing in the two loops 20 of the strap elements 18.1 may flow through the heat conducting flange members 36.1 into the brackets 32 which in turn are connected to the coolling conduits 30 and to the radiation shield 26. The heat conduction is enhanced because the bolt 38' and the nut 38 are also heat conducting. On the other hand, the washer 36.2 and the further washer 40 are made of heat insulating material, whereby a heat flow impedance is interposed between the endless loop 20 of the element 18.1 and the endless loop 20' of the element 18.2.

The securing means 34' operatively connects the endless loop 20' of the strap element 18.2 to the endless loops 22' of the strap element 18.3. Heat is to be conducted from the right-hand end of the loop 20' into the radiation shield 28 through the cooling ducts 30 and the brackets 32. However, a heat barrier is to be interposed between the loop 20' and the endless loops 22'. For these purposes the washer 36.1' is made of a heat conducting material whereas the flange 36.2' and the washer 40 are made of a heat insulating material. Heat may flow through the heat conductor washer 36.1', the bolt 38', the nut 38, and the brackets 32. The heat conducting members 36.1, 36.1' may for example, be made of an alloy comprising copper and berylium. The heat insulators 36.2 and 36.2' may be made of any suitable material. It has been found that for example titanium having a low heat conductivity is suitable for the intended purposes. The heat insulating washers 40 may be made, for example, of polyphthalate film on which aluminum has been deposited from the vapor phase. Such material constitutes a suitable heat barrier. By the above described securing means the individual elements 18.1, 18.2, and so forth are secured to each other and to the heat shields 26, 28 in a tension proof manner. Simultaneously, each end of the elements pointing toward the tank, is connected to a heat sink so to speak due to the above described heat flow into the cooling duct 30.

Due to the slanted position of the straps 12, 12' the radiation shields 26, 28 and so forth are provided with apertures 42 which are staggered relative to each other and relative to the main radiation direction so that the occurrence of so-called radiation holes in the space between the shell 6 and the low temperature tank 4 is substantially prevented. The radiation of heat flow direction extends radially toward the tank 4.

By suitably selecting the fiber material and by properly dimensioning the length of the individual elements 18.1, 18.2, and so forth it is possible to vary the heat conduction characteristic as well as the heat expansion characteristic of the suspension straps 12, 12' to thereby adapt these charcteristics to the mechanical and thermal loads which these straps are required to withstand.

The above described cooling means 26, 30 effective upstream, as viewed in the heat flow direction toward the tank 4, of the heat insulation means 36.2 and 40 has the further advantage that the heat removal takes place at a relatively high cooling temperature level. The described securing means additionally assure a tension proof connection and the heat barrier layers 40 further improve the heat insulation effect.

By utilizing the radiation shields 26, 28 as heat sinks in the manner described above, the invention does not require any additional cooling means for the individual strap elements, particularly since the radiation shields 26, 28, and so forth are generally cooled by the cooling medium vapor which is formed in the inner container 4.

The described staggering of the openings 42 in the radiation shields has the further advantage that any overlap or alignment of the openings 42 in the main radiation direction is minimized thereby avoiding the formation of so-called aligned radiation holes between the shell 6 and the container 4. Additionally, the slanted arrangement of the straps 12, 12' as taught by the invention which permits the staggering of the openings 42, facilitates the compensation of thermal changes in the length of the straps at least partially by thermally displacing the anchoring points 14 and 16.

By the formation of the loops 20, 20' and 22' as endless loops, which may be spaced or located close to each other as shown in FIG. 3, the characteristics of the fiber compound material or materials are utilized with due regard to the load requirements. These load requirements are best met by having the fibers extend uniformly in one direction in the endless loops. Incidentally, the filler member 24 shown in FIG. 4 also acts as a radiation shield.

By making the individual strap elements 18.1, 18.2, and so forth so that they have different lengths the heat conduction and heat expansion characteristics of the straps may be more closely controlled than is possible by using straps having but one strap element. The length of each individual strap element is determined by the desired thermal response characteristic of the respective strap elements.

Although the invention has been described with reference to specific example embodiments, it will be appreciated, that it is intended to cover all modifications and equivalents within the scope of the appended claims.

What is claimed is:

1. A suspension system for a low temperature tank, comprising outer shell means, a plurality of strap means of fiber compound materials, said strap means having inner and outer strap ends, first anchoring means operatively connecting said inner strap ends to said tank, second anchoring means operatively connecting said outer strap ends to said outer shell means, each of said strap means comprising a plurality of strap elements, at least certain of said strap elements being made of different fiber materials having different thermal characteristics, said strap elements being arranged so that the strap element closest to said tank is made of a fiber material having the lowest heat expansion coefficient relative to the fiber material of the strap elements further away from the tank, and means operatively securing in series said strap elements of a strap means, whereby said strap elements of a strap means form a row or sequence, one following another.

2. A suspension system for a low temperature tank, comprising outer shell means, a plurality of strap means of fiber compound materials, said strap means having inner and outer strap ends, first anchoring means operatively connecting said inner strap ends to said tank, second anchoring means operatively connecting said outer strap ends to said outer shell means, each of said strap means comprising a plurality of strap elements, at least certain of said strap elements being made of fiber materials and securing means operatively securing in series said strap elements of a strap means, whereby said strap elements of a strap means form a row or sequence, one following another, said securing means comprising heat insulation means operatively arranged to thermally insulate adjacent ends of adjacent strap elements from each other.

3. The suspension system of claim 1 or 2, wherein each strap means comprises at least three strap elements each made of a different fiber material such that the heat expansion coefficient decreases in steps from the outermost strap element adjacent the outer shell, to the strap element closest to said tank and so that the heat transfer coefficient of the strap elements increases whereby the trap element closest to the tank has the largest heat transfer coefficient.

4. The suspension system of claim 1 or 2, wherein the strap element closest to the outer shell is made of glass fibers and wherein the strap element closest to said tank is made of carbon fibers.

5. The suspension system of claim 1, further comprising heat insulation means operatively interposed between adjacent strap elements.

6. The suspension system of claim 5, further comprising cooling means operatively arranged so as to cool at least one strap element at its end located closer to said tank, said cooling means being effective upstream of the respective heat insulation means as viewed in the heat flow direction which is toward said tank from said shell.

7. The suspension system of claim 1, wherein said securing means comprise heat conducting members and heat insulation means arranged in such a manner that adjacent ends of said strap elements are heat insulated from each other, and so that heat may flow away from the downstream ends of the strap elements located upstream of the strap element which is connected to the tank, as viewed in the heat flow direction from said outer shell to said tank.

8. The suspension system of claim 2 or 7, wherein said heat insulation means comprise a thermal barrier layer (40).

9. The suspension system of claim 1 or 2, further comprising radiation shield means operatively inserted between said tank and said outer shell means, and heat conducting means (32) operatively connecting said radiation shield means to said securing means of said strap means.

10. The suspension system of claim 9, further comprising cooling means (30) operatively attached to said heat conducting means (32) whereby the radiation shield means in combination with said cooling means form a heat sink for the downstream end of the respective strap element.

11. The suspension system of claim 1 or 2, wherein said strap means are arranged at a slant relative to the central longitudinal axis of said tank and at an angle relative to a plane extending radially to said longitudinal axis of the tank.

12. The suspension system of claim 1 or 2, wherein said strap elements are made of fiber material wound in a uni-directional manner to form an endless loop.

13. The suspension system of claim 12, further comprising filler means operatively positioned inside said endless loop to form a radiation shield.

14. The suspension system of claim 1 or 2, wherein the length of each strap element is determined with regard to the heat conduction characteristic and with regard to the heat expansion characteristic of the respective strap element.

* * * * *